US009391383B2

(12) United States Patent
Nakamura

(10) Patent No.: US 9,391,383 B2
(45) Date of Patent: Jul. 12, 2016

(54) CONNECTOR

(71) Applicant: JAPAN AVIATION ELECTRONICS INDUSTRY, LIMITED, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/815,214

(22) Filed: Jul. 31, 2015

(65) Prior Publication Data

US 2016/0099513 A1 Apr. 7, 2016

(30) Foreign Application Priority Data

Oct. 3, 2014 (JP) ..... 2014-204417

(51) Int. Cl.
*H01R 12/79* (2011.01)

(52) U.S. Cl.
CPC ..... *H01R 12/79* (2013.01)

(58) Field of Classification Search
CPC .... H01R 12/79; H01R 23/684; H01R 23/668; H01R 439/26; H01R 439/495; H01R 439/496
USPC ..... 439/260, 495, 496
See application file for complete search history.

(56) References Cited

U.S. PATENT DOCUMENTS 5,839,916 A * 11/1998 Chishima ..... H01R 12/79 439/495
6,231,378 B1 * 5/2001 Wu ..... H01R 12/592 439/495
7,059,883 B2 * 6/2006 Tsai ..... H01R 12/83 439/326
7,736,164 B2 * 6/2010 Okamura ..... H01R 12/79 439/108
7,892,002 B2 * 2/2011 Shen ..... H01R 13/65802 439/260
8,579,654 B2 * 11/2013 Chen ..... H01R 12/61 439/267
8,622,766 B2 1/2014 Yokoo et al.
8,979,570 B2 3/2015 Yokoo
2007/0249217 A1 * 10/2007 Shiu ..... H01R 12/79 439/495
2008/0009180 A1 * 1/2008 Ikuta ..... H01R 12/592 439/495

(Continued)

FOREIGN PATENT DOCUMENTS

JP 2004-206987 A 7/2004
JP 4847569 B2 12/2011

(Continued)

*Primary Examiner* — Gary Paumen
(74) *Attorney, Agent, or Firm* — Collard & Roe, P.C.

(57) ABSTRACT

A connector is connectable with a plate-like or sheet-like object having an upper surface and a lower surface in an up-down direction. The upper surface is formed with an upper signal line. The lower surface is formed with a lower signal line. The connector comprises a first terminal, a second terminal, an insulator member and a housing. The first terminal has an upper-jaw portion and a lower-jaw portion. The upper-jaw portion is provided with an upper contact point. The lower-jaw portion is provided with a lower receiving portion. The second terminal is provided with a lower contact point and a press portion. When the object is connected to the connector, the insulator member is sandwiched between the press portion and the lower receiving portion to insulate the first terminal and the second terminal from each other. When the object is connected to the connector, the upper-jaw portion presses the upper contact point against the upper signal line so that the lower signal line presses the lower contact point downward while the press portion presses the insulator member against the lower receiving portion.

9 Claims, 12 Drawing Sheets

(56) References Cited

U.S. PATENT DOCUMENTS

| | | | | |
|---|---|---|---|---|
| 2010/0055940 | A1* | 3/2010 | Wang | H01R 12/79 439/77 |
| 2013/0316556 | A1* | 11/2013 | Bertsch | G06K 7/0026 439/260 |

FOREIGN PATENT DOCUMENTS

| | | | |
|---|---|---|---|
| JP | 4908606 | B2 | 4/2012 |
| JP | 2013-054886 | A | 3/2013 |
| JP | 5645312 | B2 | 12/2014 |

* cited by examiner

CONNECTOR

CROSS REFERENCE TO RELATED APPLICATIONS

An applicant claims priority under 35 U.S.C. §119 of Japanese Patent Application No. JP2014-204417 filed Oct. 3, 2014.

BACKGROUND OF THE INVENTION

This invention relates to a connector which is connected with a plate-like or sheet-like object such as a Flexible Printed Circuit (FPC) or a Flexible Flat Cable (FFC), especially to a connector which is connected with an object having signal terminals formed on both surfaces thereof.

With reference to FIG. 24, JP-A 2004-206987 (Patent Document 1) discloses a connector 900 of the aforementioned type. The connector 900 of Patent Document 1 comprises first terminals 910, second terminals 920, a housing 930 and an actuator 940. Each of the first terminals 910 is made of conductor. Each of the second terminals 920 is made of conductor. The housing 930 is made of insulator. The actuator 940 is made of insulator. In a state where the actuator 940 is opened, an object 950 is inserted into the connector 900. Thereafter, when the actuator 940 is closed as shown in FIG. 24, the first terminals 910 are deformed so that the first terminals 910 and the second terminals 920 hold the object 950 therebetween. Accordingly, the first terminals 910 and the second terminals 920 are connected with signal lines which are formed on both surfaces of the object 950.

SUMMARY OF THE INVENTION

It is an object of the present invention to provide a connector which is connected with an object having signal terminals formed on both surfaces thereof and which has a reduced size.

One aspect of the present invention provides a connector connectable with a plate-like or sheet-like object having an upper surface and a lower surface in an up-down direction. The upper surface is formed with an upper signal line. The lower surface is formed with a lower signal line. The connector comprises a first terminal, a second terminal, an insulator member and a housing. The first terminal is held by the housing. The first terminal has an upper-jaw portion and a lower-jaw portion. The lower-jaw portion is positioned below the upper-jaw portion in the up-down direction. The upper-jaw portion is provided with an upper contact point so that the upper contact point is movable at least in the up-down direction. The lower-jaw portion is provided with a lower receiving portion. The second terminal is distinct and separated from the first terminal. The second terminal is held by the housing. The second terminal is provided with a lower contact point and a press portion. The press portion is positioned below the lower contact point. When the object is connected to the connector, the insulator member is sandwiched between the press portion and the lower receiving portion to insulate the first terminal and the second terminal from each other. When the object is connected to the connector, the upper-jaw portion presses the upper contact point against the upper signal line so that the lower signal line presses the lower contact point downward while the press portion presses the insulator member against the lower receiving portion.

The upper contact point of the upper-jaw portion of the first terminal presses the object downward while the pressed object is pressed against the lower receiving portion of the lower-jaw portion of the first terminal through the lower contact point of the second terminal and the insulator member. Thus, a force balance between the upper-jaw portion and the lower-jaw portion of the first terminal can be achieved so that an unnecessary load is never applied to the housing. Accordingly, the housing can have a reduced size so that an overall size of the connector can be reduced.

Figure 1:
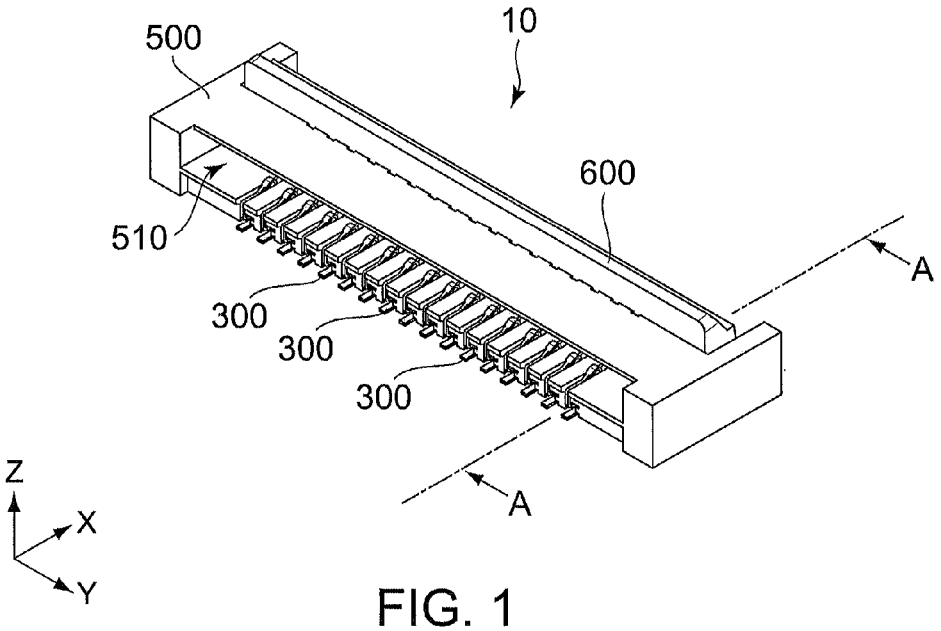
FIG. 1 is a perspective view showing a connector according to a first embodiment of the present invention. An actuator included in the illustrated connector is under an open state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 11:
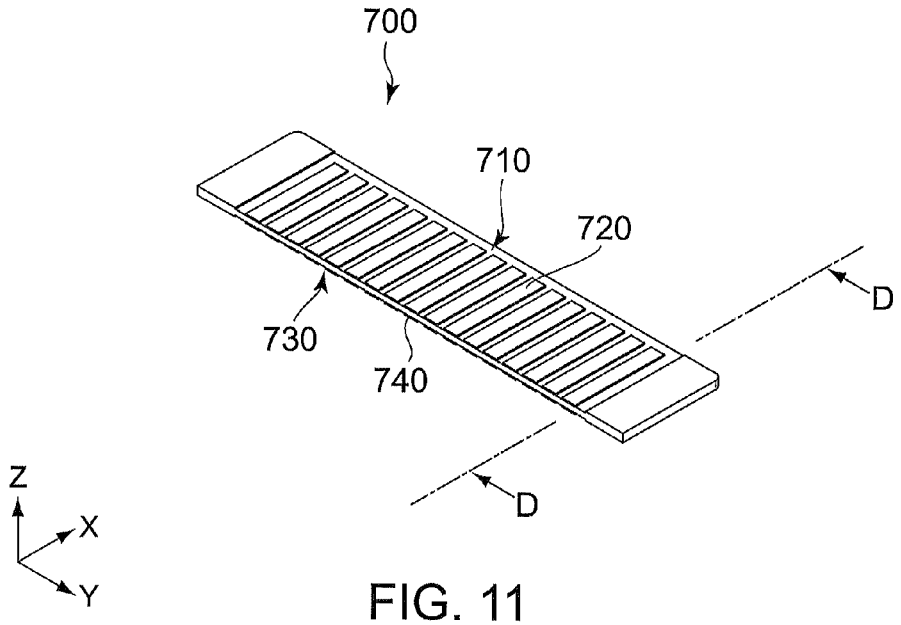
FIG. 11 is a perspective view showing an object which is connected to the connector of FIG. 3.
Figure 12:
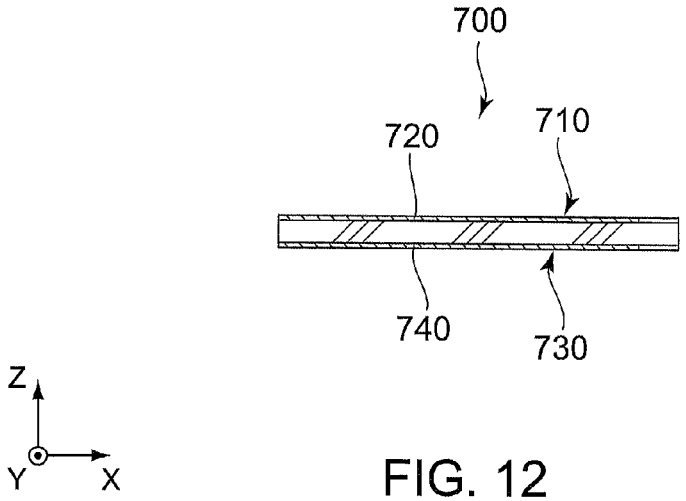
FIG. 12 is a cross-sectional view showing the object of FIG. 11, taken along line D-D.
Figure 13:
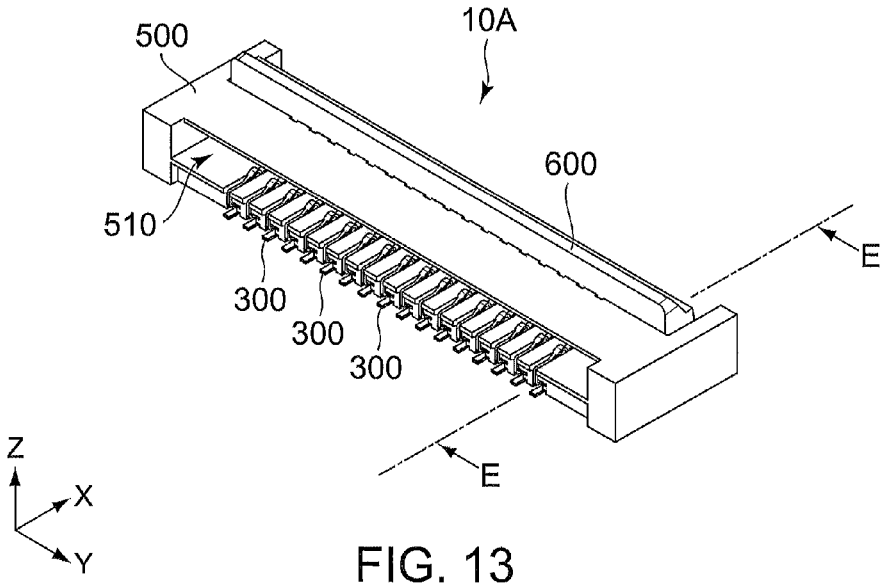
FIG. 13 is a perspective view showing a connector according to a second embodiment of the present invention. An actuator included in the illustrated connector is under an open state.

With reference to FIGS. 1 to 4, a connector 10 according to a first embodiment of the present invention is to be mounted and fixed on a circuit board (not shown). In addition, the connector 10 according to the first embodiment of the present invention is connectable with a plate-like or sheet-like object 700. As shown in FIGS. 11 and 12, the object 700 has an upper surface 710 and a lower surface 730 in an up-down direction, or a Z-direction. The upper surface 710 is formed with a plurality of upper signal lines 720, and the lower surface 730 is formed with a plurality of lower signal lines 740. The plurality of upper signal lines 720 are arranged on the upper surface 710 in a pitch direction, or a Y-direction, perpendicular to the up-down direction. Similarly, the plurality of lower signal lines 740 are arranged on the lower surface 730 in the pitch direction.

As understood from FIGS. 1 to 4, the connector 10 comprises a plurality of first terminals 100, a plurality of second terminals 300, an insulator member 400, a housing 500 and an actuator 600. Each of the first terminals 100 is made of conductor. Each of the second terminals 300 is made of conductor. The housing 500 is made of insulator. The actuator 600 is made of insulator. The first terminals 100 are distinct and separated from each other. Similarly, the second terminals 300 are distinct and separated from each other. In the present embodiment, the number of the first terminals 100 is equal to the number of the second terminals 300, and the first terminals 100 correspond to the second terminals 300, respectively.

Figure 7:
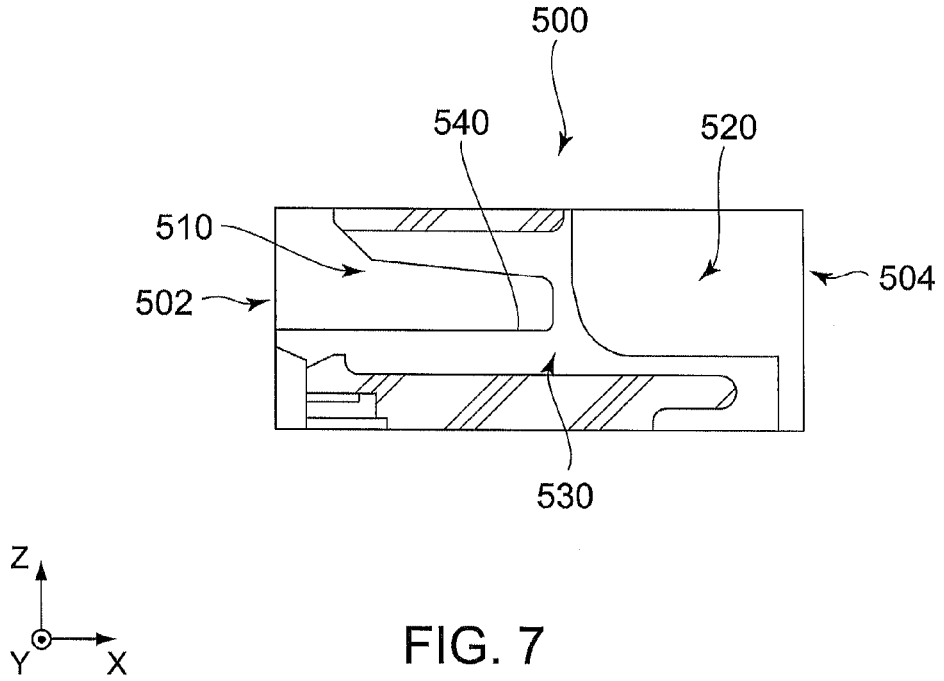
FIG. 7 is a cross-sectional view showing a housing which is included in the connector of FIG. 2.

As shown in FIG. 7, the housing 500 is formed with a receive portion 510, an actuator accommodation portion 520, a plurality of terminal accommodation portions 530 and a mount portion 540. The housing 500 has a front end 502 and a rear end 504 in a front-rear direction, or an X-direction, perpendicular to both the up-down direction and the pitch direction. The receive portion 510 is opened at the front end 502. The actuator accommodation portion 520 is positioned toward the rear end 504 and opened rearward, or in a positive X-direction, and upward, or in a positive Z-direction. The terminal accommodation portions 530 correspond to the first terminals 100, respectively. Each of the terminal accommodation portions 530 connects between the receive portion 510 and the actuator accommodation portion 520. The mount portion 540 is a rearward area, or a positive X-side area, of a bottom surface of the receive portion 510. While the mount portion 540 is formed with ditches which form parts of the terminal accommodation portions 530, respectively, the mount portion 540 essentially has a plane parallel to an XY-plane, or a plane which is defined by the front-rear direction and the pitch direction.

Figure 2:
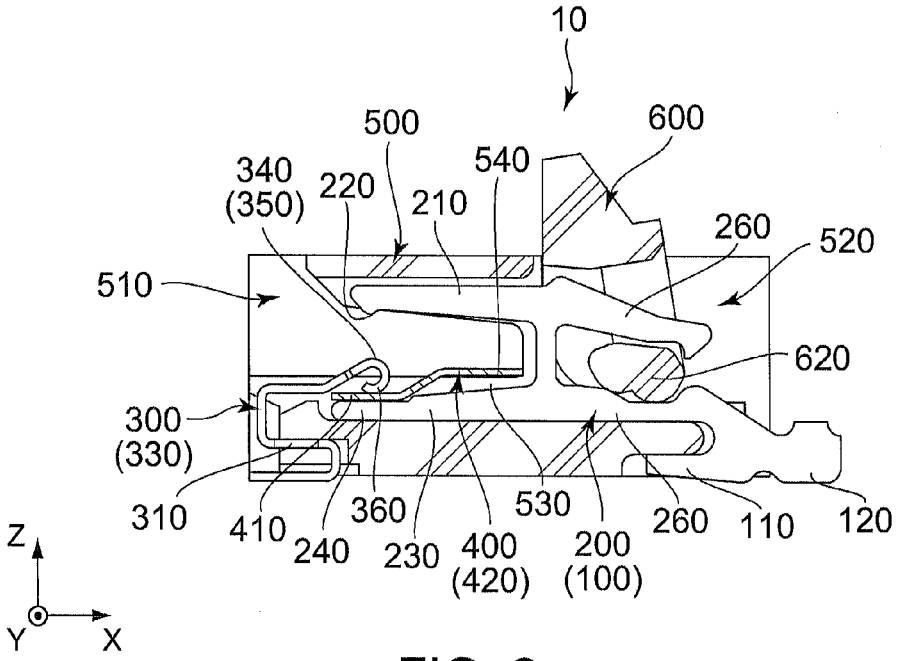
FIG. 2 is a cross-sectional view showing the connector of FIG. 1, taken along line A-A.
Figure 3:
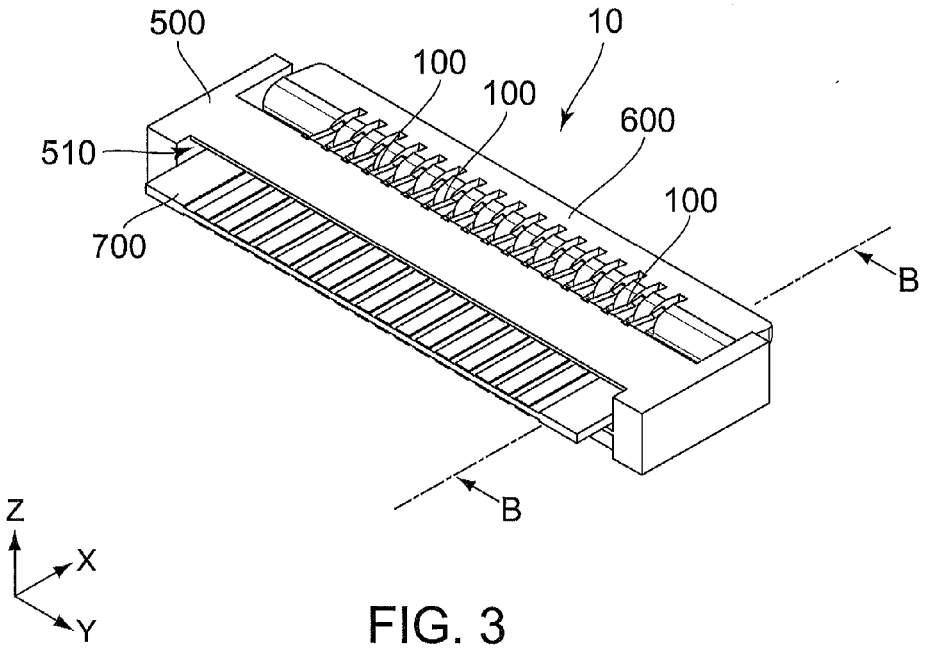
FIG. 3 is a perspective view showing the connector of FIG. 1. The actuator is under a close state.
Figure 4:
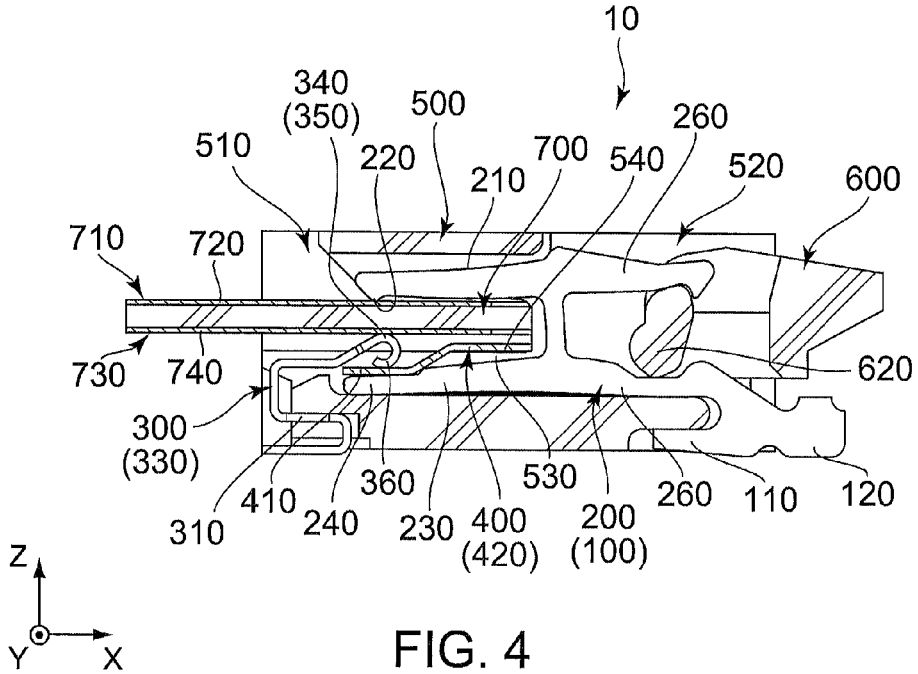
FIG. 4 is a cross-sectional view showing the connector of FIG. 3, taken along line B-B.
Figure 5:
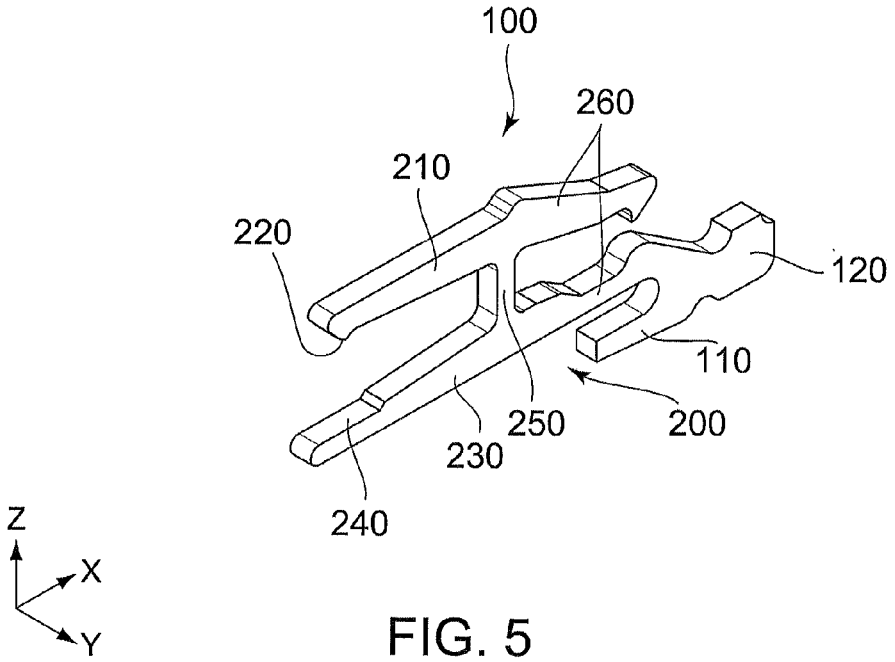
FIG. 5 is a perspective view showing a first terminal which is included in the connector of FIG. 1.

As shown in FIG. 5, each of the first terminals 100 has a first held portion 110, a first fixed portion 120 and a first terminal main portion 200. As shown in FIGS. 2 and 4, the first held portion 110 is a portion which is held by the housing 500. In the present embodiment, each of the first held portions 110 is positioned in the vicinity of a rear end, or a positive X-side end, of the connector 10. When the connector 10 is mounted and fixed on the circuit board (not shown), each of the first fixed portions 120 is fixed on the circuit board. Each of the first fixed portions 120 of the present embodiment is positioned in the vicinity of the rear end of the connector 10.

As shown in FIG. 5, the first terminal main portion 200 of the first terminal 100 has an upper-jaw portion 210, a lower-jaw portion 230, a coupling portion 250 and operated portions 260. The coupling portion 250 couples the upper-jaw portion 210 with the lower-jaw portion 230. The upper-jaw portion 210 extends frontward, or in a negative X-direction, from the coupling portion 250. The upper-jaw portion 210 is provided with an upper contact point 220. The upper contact point 220 protrudes downward, or in a negative Z-direction. Since the upper-jaw portion 210 and the coupling portion 250 are resiliently deformable, the upper contact point 220 is movable at least in the up-down direction. The lower-jaw portion 230 extends frontward from the coupling portion 250 and is positioned below the upper-jaw portion 210 in the up-down direction. The lower-jaw portion 230 is provided with a lower receiving portion 240. The lower receiving portion 240 of the present embodiment has a rectangular shaped plane perpendicular to the up-down direction. The lower receiving portion 240 overlaps the upper contact point 220 in the front-rear direction. In other words, in the front-rear direction, a position of the upper contact point 220 is within a region which is occupied by the lower receiving portion 240. Specifically, when the first terminal 100 is viewed alone, or when the first terminal 100 is in a state where it is not yet incorporated in the connector 10, the upper contact point 220 faces the lower receiving portion 240 in the up-down direction. The operated portions 260 form a structure having a C-like shape in cooperation with the coupling portion 250. As described later, the operated portions 260 are portions which are operated by the actuator 600.

As shown in FIGS. 2 and 4, each of the first held portions 110 is held by the housing 500 so that each of the first terminals 100 is incorporated in the housing 500. In detail, as understood from FIG. 3, the first terminals 100 are arranged in the pitch direction. As shown in FIG. 2, each of the first terminals 100 is partially accommodated in the corresponding terminal accommodation portion 530 so that each of the upper contact points 220 protrudes in the receive portion 510. In addition, as shown in FIGS. 2 and 4, each of the operated portions 260 of the present embodiment is partially accommodated in the actuator accommodation portion 520.

Figure 6:
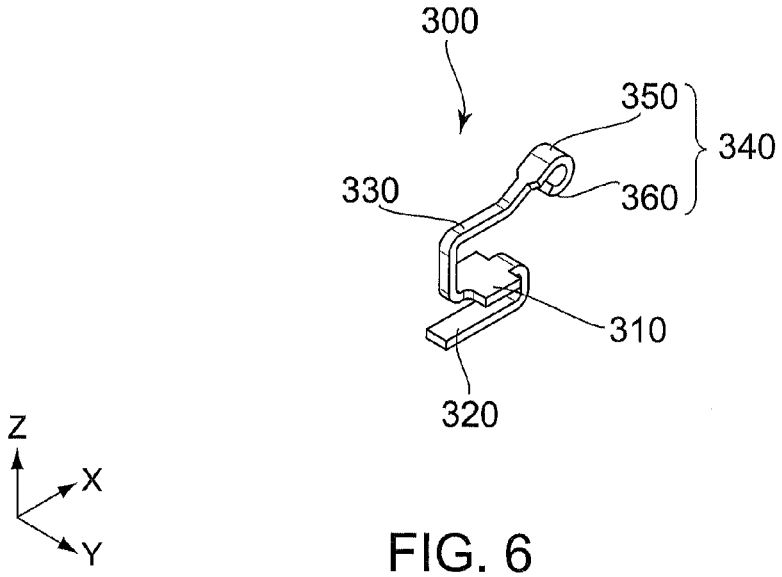
FIG. 6 is a perspective view showing a second terminal which is included in the connector of FIG. 1.

As apparent from FIGS. 2, 5 and 6, each of the second terminals 300 is distinct and separated from the corresponding first terminal 100. As shown in FIG. 6, each of the second terminals 300 has a second held portion 310, a second fixed portion 320, a support portion 330 and a supported portion 340. As understood from FIGS. 1, 2, 6 and 7, the second held portion 310 is a portion which is held by the housing 500. In the present embodiment, each of the second held portions 310 is positioned in the vicinity of a front end, or a negative X-side end, of the connector 10. When the connector 10 is mounted and fixed on the circuit board (not shown), each of the second fixed portions 320 is fixed on the circuit board. Each of the second fixed portions 320 of the present embodiment is positioned in the vicinity of the front end of the connector 10. As shown in FIG. 6, the support portion 330 supports the supported portion 340. Since the support portion 330 is resiliently deformable, the supported portion 340 is movable at least in the up-down direction. The supported portion 340 is provided with a lower contact point 350 and a press portion 360. As understood from FIGS. 2 and 6, the lower contact point 350 faces upward while the press portion 360 faces downward. As understood from the aforementioned movability of the supported portion 340 in the up-down direction, the lower contact point 350 and the press portion 360 of the present embodiment are movable in the up-down direction.

As shown in FIGS. 2 and 4, each of the second terminals 300 is held by the housing 500. In detail, as shown in FIG. 1, the second terminals 300 are arranged in the pitch direction. As understood from FIGS. 2 and 4, each one of the first terminals 100 and a corresponding one of the second terminals 300 are positioned at positions same as each other in the pitch direction. Furthermore, as understood from FIG. 2, each of the lower contact points 350 protrudes in the receive portion 510.

Figure 8:
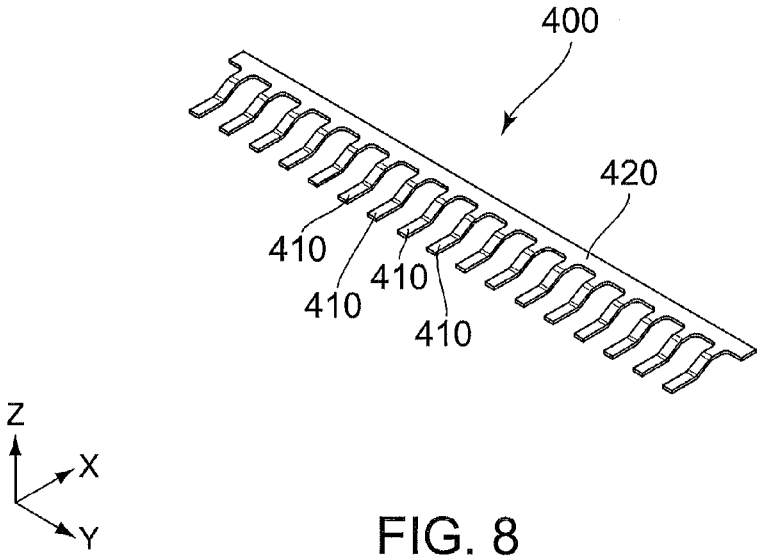
FIG. 8 is a perspective view showing an insulator member which is included in the connector of FIG. 1.
Figure 9:
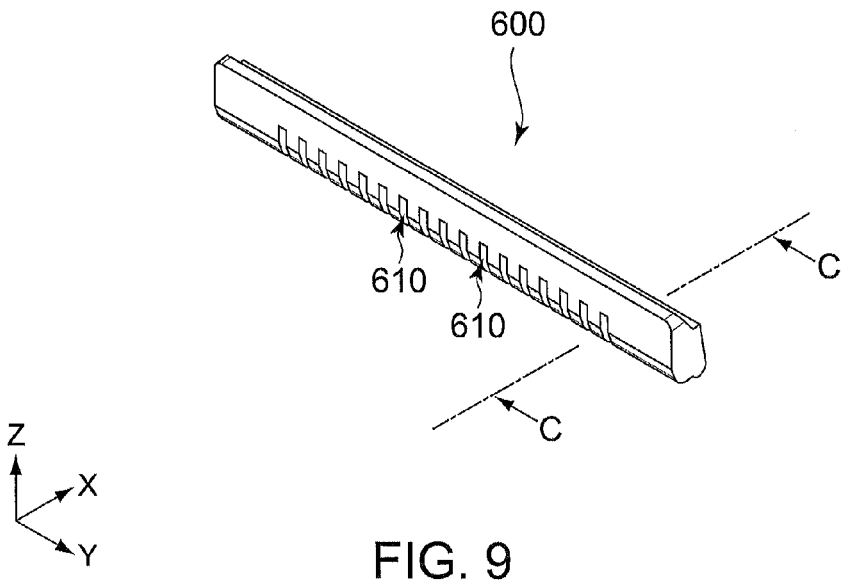
FIG. 9 is a perspective view showing the actuator which is included in the connector of FIG. 1.

As understood from FIGS. 7 to 9, the insulator member 400 of the present embodiment is distinct and separated from each of the housing 500 and the actuator 600. However, the present invention is not limited thereto. The connector 10 may be modified so that either a part of the housing 500 or a part of the actuator 600 is the insulator member, provided that movements similar to those described later can be realized in the modified connector 10.

As shown in FIG. 8, the insulator member 400 has a plurality of insulation portions 410 and a coupling portion 420. The coupling portion 420 couples the insulation portions 410 with each other. Specifically, the insulator member 400 of the present embodiment is formed of a single member which has the plurality of insulation portions 410. As understood from FIGS. 2 and 8, the insulation portions 410 correspond to the second terminals 300, respectively. In other words, the number of the insulation portions 410 is equal to the number of the second terminals 300. The coupling portion 420 of the insulator member 400 is partially mounted on the mount portion 540 of the housing 500 while the insulation portions 410 are arranged on the lower receiving portions 240 of the first terminals 100, respectively. Meanwhile, the insulator member 400 may be glued and fixed on the mount portion 540 of the housing 500 or the lower receiving portions 240 of the first terminals 100. In this state, when the second terminals 300 are incorporated to the housing 500, each of the insulation portions 410 of the insulator member 400 is sandwiched between the press portion 360 of the corresponding second terminal 300 and the lower receiving portion 240 of the corresponding first terminal 100. Accordingly, each of the first terminals 100 is insulated from the corresponding second terminal 300.

As shown in FIG. 2, in the present embodiment, the upper contact points 220, the lower contact points 350, the press portions 360, the insulation portions 410 and the lower receiving portions 240 are positioned on imaginary straight lines, respectively, each parallel to the up-down direction. In other words, the upper contact points 220, the lower contact points 350, the press portions 360, the insulation portions 410 and the lower receiving portions 240 are arranged on straight lines, respectively, each extending along the up-down direction.

Figure 10:
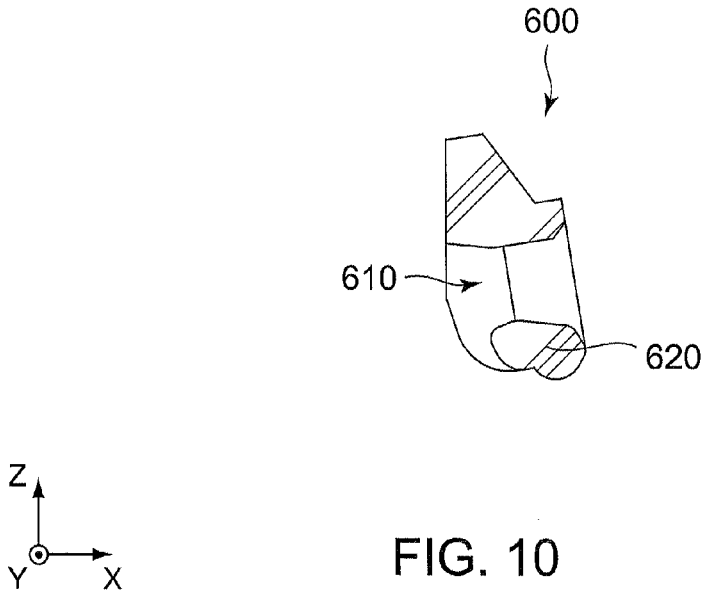
FIG. 10 is a cross-sectional view showing the actuator of FIG. 9, taken along line C-C.

As shown in FIG. 9, the actuator 600 is formed with a plurality of channels 610. The channels 610 correspond to the first terminals 100 as shown in FIG. 2, respectively. As shown in FIG. 10, action cams 620 are provided inside the channels 610, respectively. As shown in FIGS. 2 and 4, the actuator 600 is attached to the first terminals 100 so that the actuator 600 is partially accommodated in the actuator accommodation portion 520 while each of the action cams 620 is positioned between the corresponding operated portions 260. The aforementioned attachment of the actuator 600 enables the actuator 600 to be rotatable between an open state shown in FIG. 2 and a close state shown in FIG. 4.

As understood from FIG. 2, when the actuator 600 is under the open state, each of the action cams 620 does not apply any force to the corresponding operated portions 260. At that time, a dimension of a distance between the upper contact point 220 and the lower contact point 350 in the up-down direction is larger than another dimension of a thickness of the object 700 as shown in FIG. 4. Accordingly, when the actuator 600 is under the open state, the object 700 can be inserted into the receive portion 510 without applying any force thereto.

On the other hand, as understood from FIG. 4, when the actuator 600 is under the close state, each of the action cams 620 pushes the corresponding operated portions 260 to widen a gap therebetween. Thus, the corresponding upper contact point 220 is moved downward when the actuator 600 is under the close state. In detail, when the object 700 is connected to the connector 10, the upper-jaw portions 210 press the upper contact points 220 against the upper signal lines 720 of the object 700, respectively. At that time, the lower signal lines 740 press the lower contact points 350 downward, respectively, while the press portions 360 press the insulation portions 410 of the insulator member 400 against the lower receiving portions 240, respectively. Specifically, when the object 700 is connected to the connector 10, the insulation portions 410 of the insulator member 400 and the supported portions 340 are sandwiched between the lower surface 730 of the object 700 and the lower receiving portions 240, respectively. Since each of forces applied from the upper-jaw portions 210 is received by the lower-jaw portion 230 as described above, an unnecessary load is never applied to the housing 500 when the object 700 is connected to the connector 10. Accordingly, in the present embodiment, the housing 500 can be reduced in size so that an overall size of the connector 10 can be reduced.

In particular, in the present embodiment, when the object 700 is connected to the connector 10, the object 700 is sandwiched between the upper contact points 220 and the lower contact points 350 in the up-down direction. Accordingly, it is not necessary for the connector 10 to be provided with support means for supporting the object 700. However, the present invention is not limited thereto. For example, the connector 10 may be additionally provided with a supporting portion or member for supporting the object 700 on an upper side or a lower side of the inserted object 700 so that the object 700 is supported by the supporting portion or member, the upper contact points 220 and the lower contact points 350.

Second Embodiment

With reference to FIGS. 13 to 17, a connector 10A according to a second embodiment of the present invention has a structure same as that of the connector 10 according to the aforementioned first embodiment as shown in FIG. 1 except for an insulator member 400A. Accordingly, components of the connector 10A shown in FIGS. 13 to 17 which are same as those of connector 10 of the first embodiment are referred by using reference signs same as those of the connector 10 of the first embodiment. As understood from FIGS. 13 to 17, the connector 10A of the present embodiment comprises first terminals 100, second terminals 300, the insulator member 400A, a housing 500 and an actuator 600. The first terminal 100, the second terminal 300, the housing 500 and the actuator 600 have structures same as those of the connector 10 of the aforementioned first embodiment. Accordingly, detailed explanation thereabout is omitted.

Figure 17:
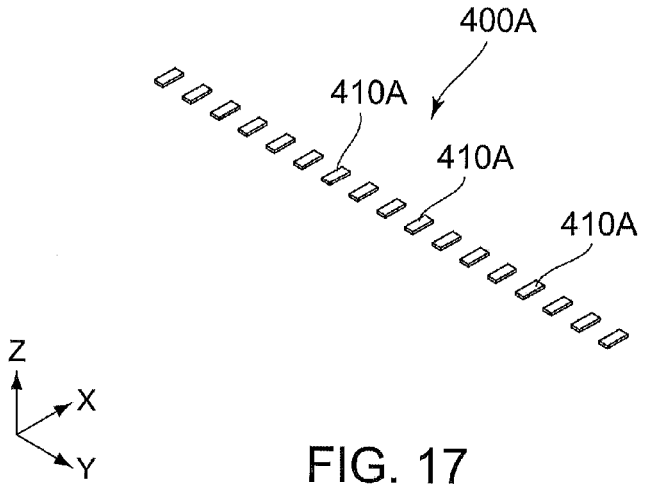
FIG. 17 is a perspective view showing an insulator member which is included in the connector of FIG. 13.

As shown in FIG. 17, the insulator member 400A of the present embodiment consists only of a plurality of insulation portions 410A. Specifically, the insulation portions 410A of the present embodiment are distinct and separated from each other. In addition, the insulation portions 410A of the present embodiment are not coupled with each other. The insulation portions 410A are provided to correspond to the second terminals 300 as shown in FIG. 14, respectively.

Figure 14:
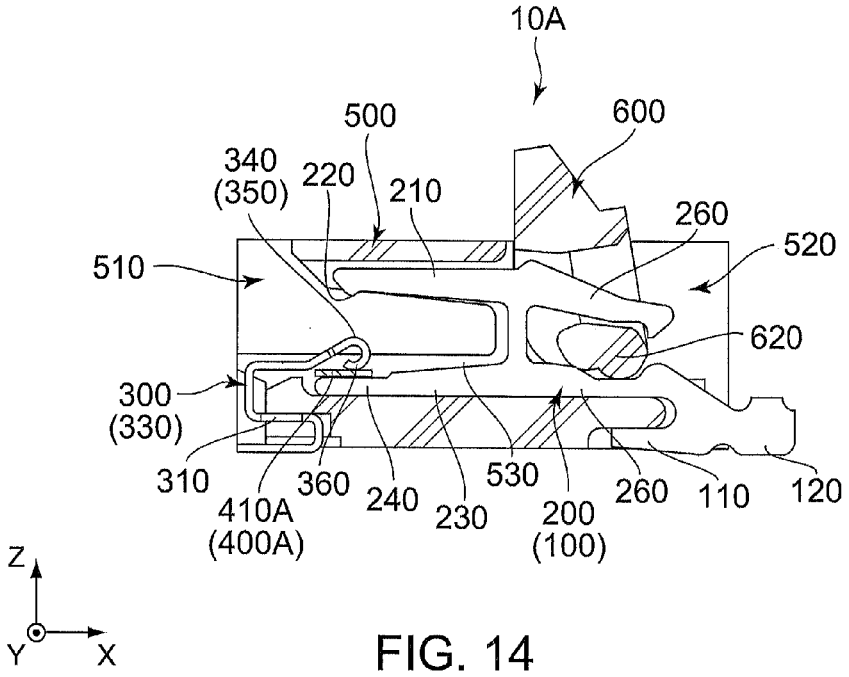
FIG. 14 is a cross-sectional view showing the connector of FIG. 13, taken along line E-E.
Figure 15:
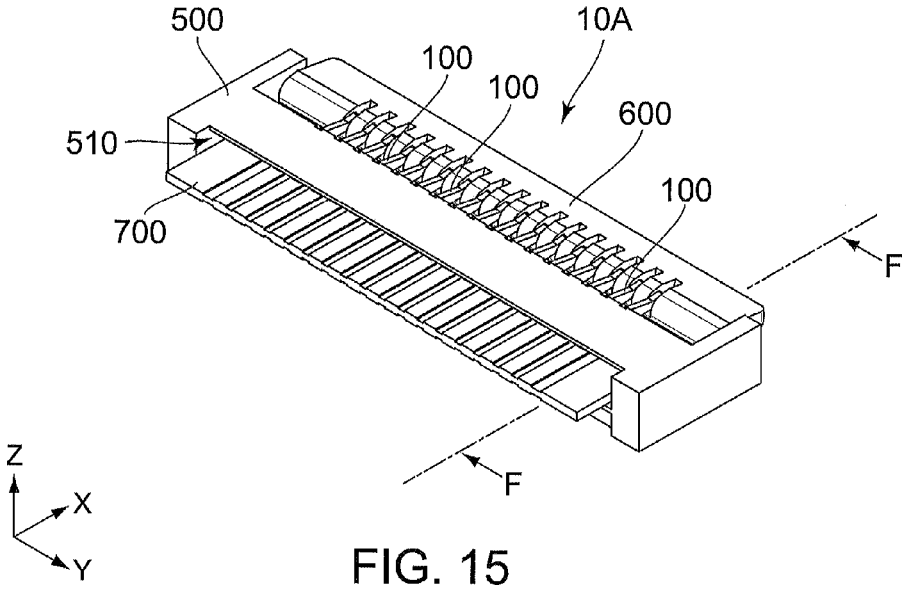
FIG. 15 is a perspective view showing the connector of FIG. 13. The actuator is under a close state.
Figure 16:
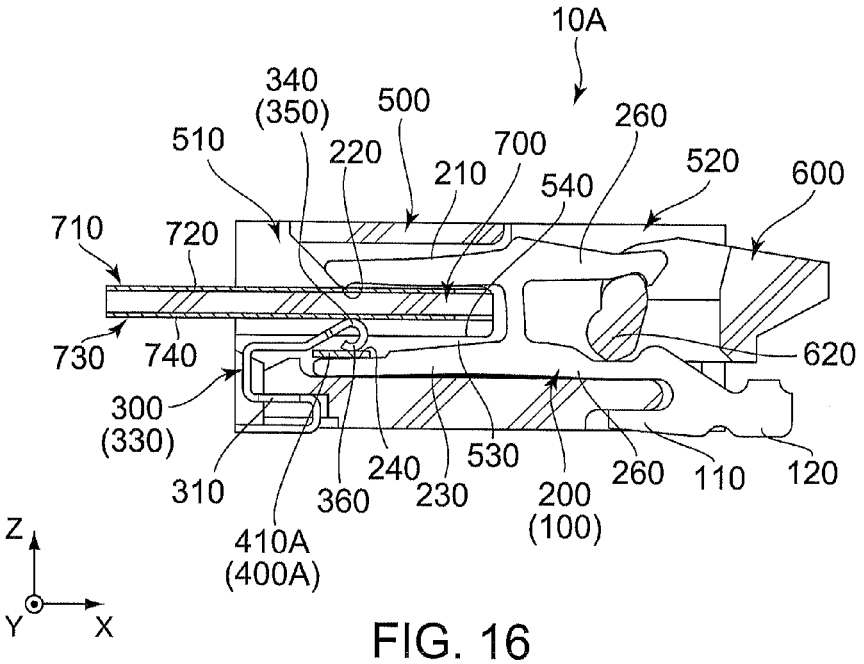
FIG. 16 is a cross-sectional view showing the connector of FIG. 15, taken along line F-F.

Specifically, as shown in FIGS. 14 and 16, the insulation portions 410 A of the insulator member 400A are temporary fixed to the lower receiving portions 240 by adhesive, respectively, and are then sandwiched between the lower receiving portions 240 of the lower-jaw portions 230 of the first terminals 100 and the press portions 360 of the supported portions 340 of the second terminals 300, respectively, in the up-down direction. Each of the insulation portions 410A may be temporary fixed to the corresponding press portion 360 instead of being fixed to the corresponding lower receiving portion 240.

As shown in FIG. 16, when the actuator 600 of the connector 10A is put in a close state, the upper contact points 220 of the upper-jaw portions 210 are pressed against the upper surface 710 of the object 700. Since each of forces applied from the upper-jaw portions 210 is received by the lower receiving portion 240 of the lower-jaw portion 230 through the corresponding second terminal 300 and the insulator member 400A, an unnecessary load is never applied to the housing 500 when the object 700 is connected to the connector 10A. Accordingly, in the present embodiment, the housing 500 can be reduced in size so that an overall size of the connector 10A can be reduced.

Third Embodiment

With reference to FIGS. 18 to 23, a connector 10B according to a third embodiment of the present invention has a structure same as that of the connector 10 according to the aforementioned first embodiment as shown in FIG. 1 except for an insulator member 400B and a housing 500B. Accordingly, components of the connector 10B shown in FIGS. 18 to 23 which are same as those of the connector 10 of the first embodiment are referred by using reference signs same as those of the connector 10 of the first embodiment. As understood from FIGS. 18 to 23, the connector 10B of the present embodiment comprises first terminals 100, second terminals 300, the insulator member 400B, the housing 500B and an actuator 600. The first terminal 100, the second terminal 300 and the actuator 600 have structures same as those of the connector 10 of the aforementioned first embodiment. Accordingly, detailed explanation thereabout is omitted.

Figure 21:
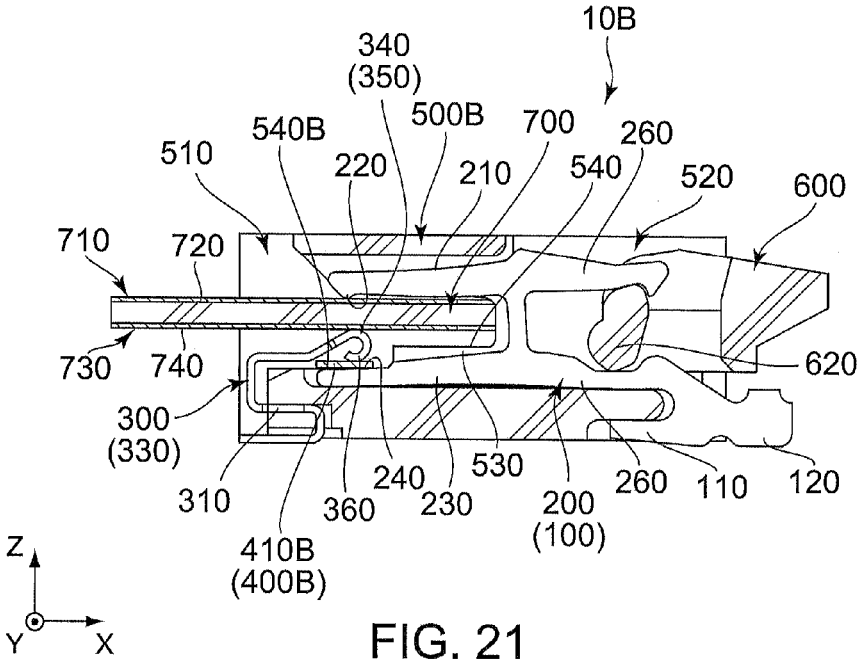
FIG. 21 is a cross-sectional view showing the connector of FIG. 20, taken along line H-H.
Figure 22:
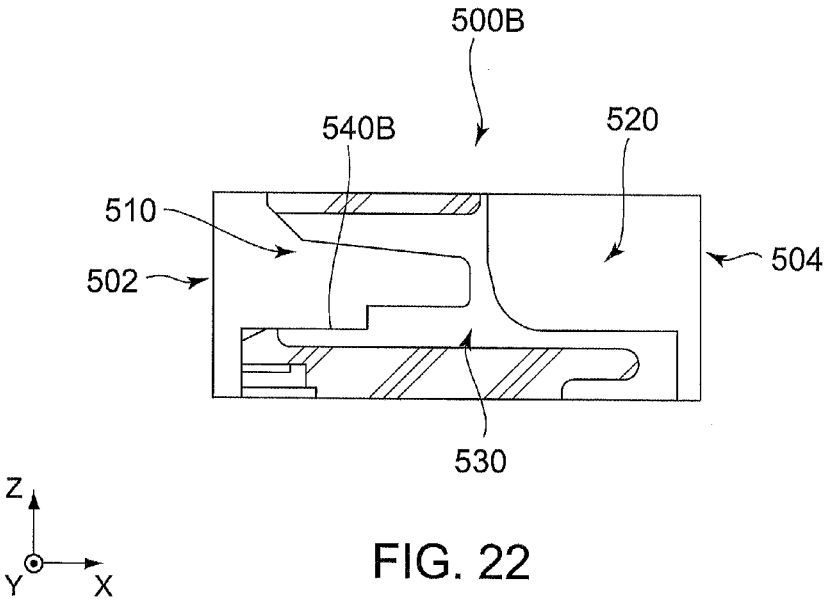
FIG. 22 is a cross-sectional view showing a housing which is included in the connector of FIG. 19.

As shown in FIG. 22, the housing 500B is formed with a receive portion 510, an actuator accommodation portion 520, a plurality of terminal accommodation portions 530 and a mount portion 540B. The receive portion 510, the actuator accommodation portion 520 and the terminal accommodation portions 530 are essentially same as those of the housing 500 of the aforementioned first embodiment as shown in FIG. 7. The mount portion 540B is a frontward area, or a negative X-side area, of a bottom surface of the receive portion 510. While the mount portion 540B is formed with ditches which form parts of the terminal accommodation portions 530, respectively, the mount portion 540B essentially has a plane parallel to the XY-plane, or a plane which is defined by the front-rear direction and the pitch direction. In particular, as understood from FIGS. 19 and 21, the mount portion 540B of the present embodiment is positioned at a position almost same as each of those of the lower receiving portions 240 in the up-down direction.

Figure 23:
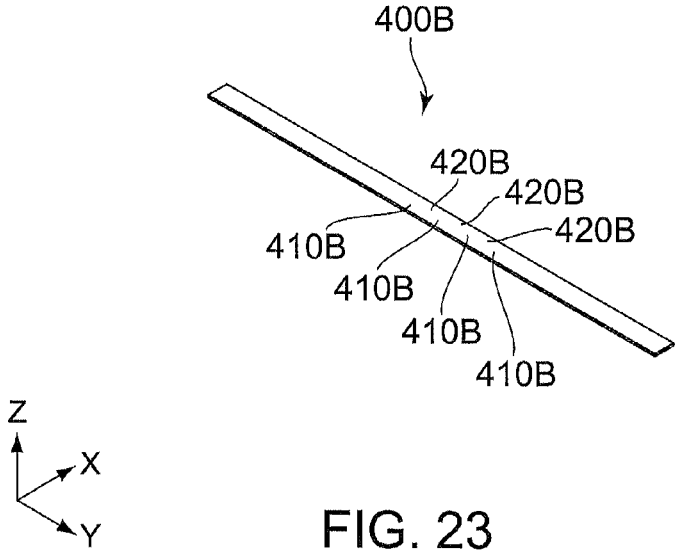
FIG. 23 is a perspective view showing an insulator member which is included in the connector of FIG. 18.
Figure 24:
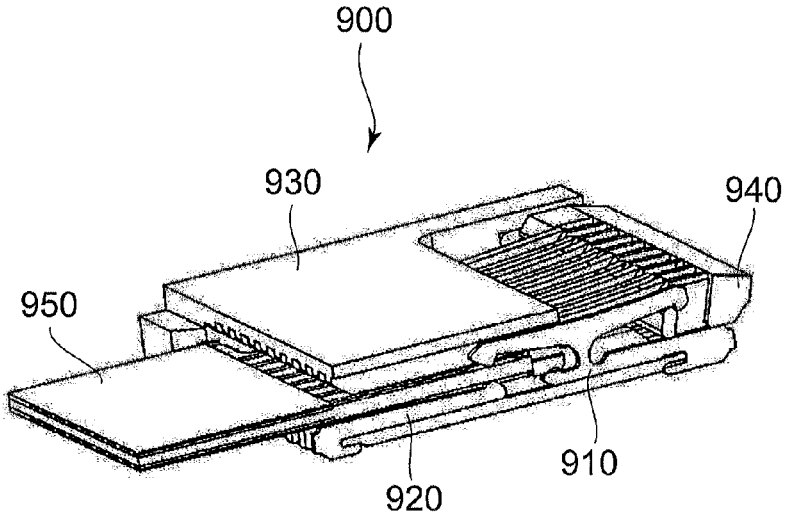
FIG. 24 PRIOR ART
FIG. 24 is a perspective, cross-sectional view showing a connector of Patent Document 1.

As shown in FIG. 23, the insulator member 400B of the present embodiment has an elongated, plate-like shape. The insulator member 400B includes a plurality of insulation portions 410B and a plurality of coupling portions 420B. Specifically, the insulator member 400B is formed of a single member which has the plurality of insulation portions 410B. The insulation portions 410B are provided to correspond to the second terminals 300 as shown in FIG. 21, respectively. In addition, the insulation portions 410B are positioned away from each other in the pitch direction. Each of the coupling portions 420B couples between the two insulation portions 410B adjacent to each other in the pitch direction.

Figure 18:
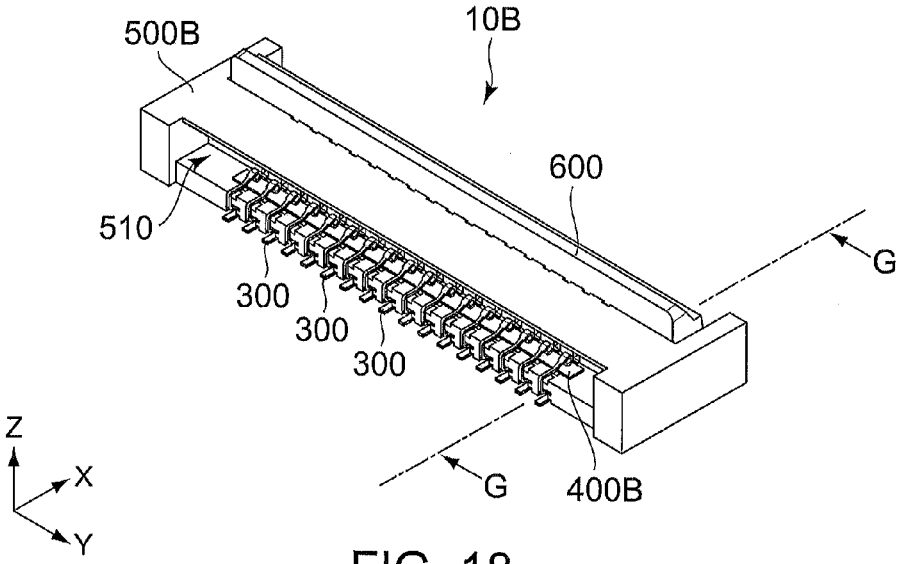
FIG. 18 is a perspective view showing a connector according to a third embodiment of the present invention. An actuator included in the illustrated connector is under an open state.
Figure 19:
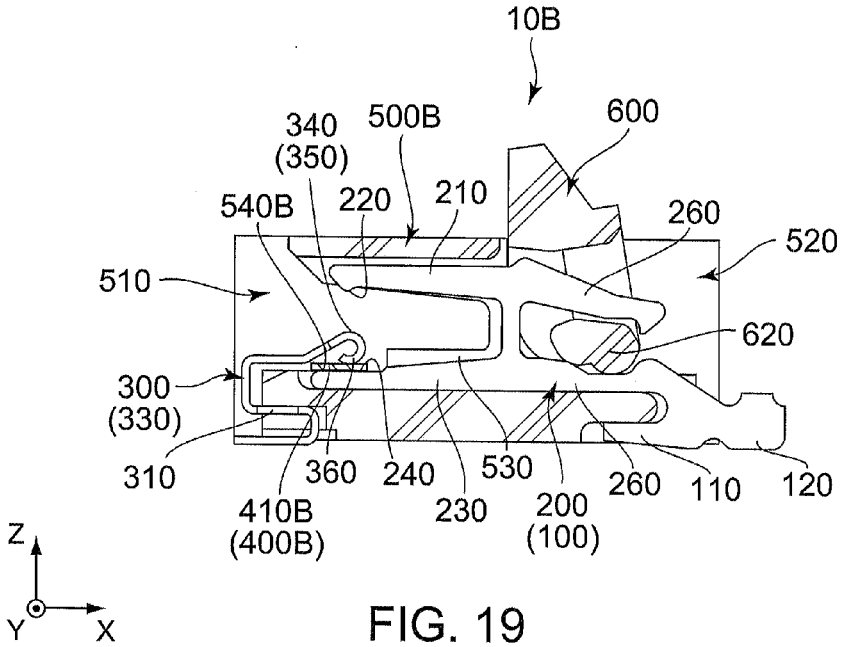
FIG. 19 is a cross-sectional view showing the connector of FIG. 18, taken along line G-G.
Figure 20:
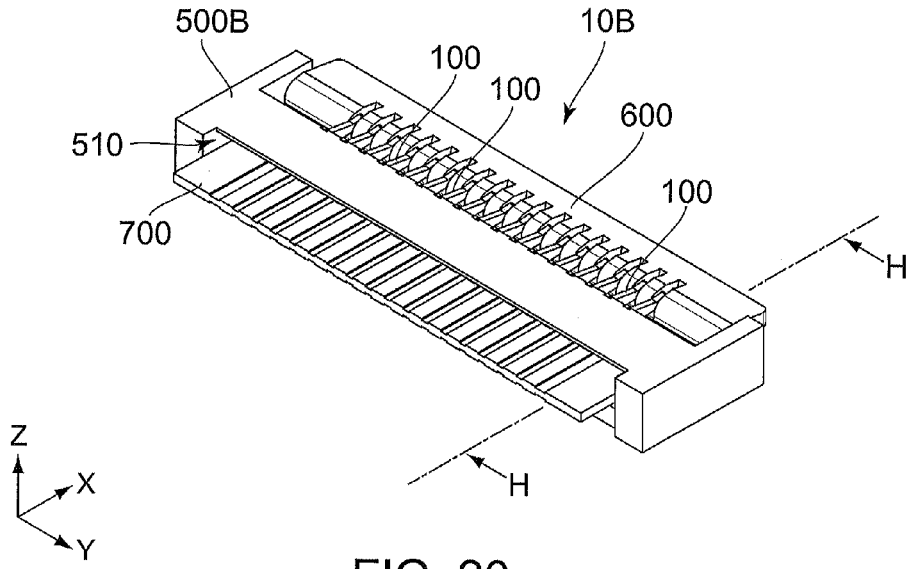
FIG. 20 is a perspective view showing the connector of FIG. 18. The actuator is under a close state.

As shown in FIGS. 18, 19 and 21, the insulator member 400B is mounted on the mount portion 540B. As shown in FIGS. 19 and 21, the insulation portions 410B of the insulator member 400B are sandwiched between the lower receiving portions 240 of the lower-jaw portions 230 of the first terminals 100 and the press portions 360 of the supported portions 340 of the second terminals 300, respectively, in the up-down direction.

As shown in FIG. 21, when the actuator 600 of the connector 10B is put in a close state, the upper contact points 220 of the upper-jaw portions 210 are pressed against the upper surface 710 of the object 700. Since each of forces applied from the upper-jaw portions 210 is received by the lower receiving portion 240 of the lower-jaw portion 230 through the corresponding second terminal 300 and the insulator member 400B, respectively, an unnecessary load is never applied to the housing 500B when the object 700 is connected to the connector 10B. Accordingly, in the present embodiment, the housing 500B can be reduced in size so that an overall size of the connector 10B can be reduced.

While the present invention has been described with specific embodiments, the present invention is not limited to the aforementioned embodiments. The present invention is variously modifiable.

For example, each of the connector 10, 10A and 10B of the aforementioned embodiments comprises the actuator 600. However the present invention is not limited thereto. The connector 10, 10A, 10B may not comprise the actuator 600 so that an insertion force is required to insert the object 700 into the connector 10, 10A, 10B.

In the aforementioned embodiment, each of the insulation portions 410, 410A, 410B of the insulator member 400, 400A, 400B is sandwiched between the press portion 360 of the corresponding second terminal 300 and the lower receiving portion 240 of the corresponding first terminal 100, and insulates the press portion 360 of the corresponding second terminal 300 and the lower receiving portion 240 of the corresponding first terminal 100 from each other. However, the present invention is not limited thereto. At least one of the press portion 360 of the second terminal 300 and the lower receiving portion 240 of the first terminal 100 may be positioned away from the corresponding insulation portion 410, 410A, 410B of the insulator member 400, 400A, 400B before the object 700 is connected to the connector 10, 10A, 10B, provided that each of the insulation portions 410, 410A, 410B of the insulator member 400, 400A, 400B is sandwiched between the press portion 360 of the corresponding second terminal 300 and the lower receiving portion 240 of the corresponding first terminal 100, for example, when the object 700 is connected to the connector 10, 10A, 10B.

Although a part of the housing 500, 500B is positioned just below the lower receiving portions 240 of the aforementioned embodiments, the present invention is not limited thereto. For example, the housing 500, 500B may be formed with cavities which are positioned just below the lower receiving portions 240, respectively. In addition, each of the cavities may allow the corresponding lower receiving portion 240 to be movable in the up-down direction by resilient deformation of the lower-jaw portion 230 or the coupling portion 250.

The present application is based on a Japanese patent application of JP2014-204417 filed before the Japan Patent Office on Oct. 3, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable with a plate-like or sheet-like object having an upper surface and a lower surface in an up-down direction, the upper surface being formed with an upper signal line, the lower surface being formed with a lower signal line, wherein:

the connector comprises a first terminal, a second terminal, an insulator member and a housing;

the first terminal is held by the housing;

the first terminal has an upper-jaw portion and a lower-jaw portion;

the lower-jaw portion is positioned below the upper-jaw portion in the up-down direction;

the upper-jaw portion is provided with an upper contact point so that the upper contact point is movable at least in the up-down direction;

the lower-jaw portion is provided with a lower receiving portion;

the second terminal is distinct and separated from the first terminal;

the second terminal is held by the housing;

the second terminal is provided with a lower contact point and a press portion;

the press portion is positioned below the lower contact point;

when the object is connected to the connector, the insulator member is sandwiched between the press portion and the lower receiving portion to insulate the first terminal and the second terminal from each other; and when the object is connected to the connector, the upper-jaw portion presses the upper contact point against the upper signal line so that the lower signal line presses the lower contact point downward while the press portion presses the insulator member against the lower receiving portion.

2. The connector as recited in claim 1, wherein:

the second terminal has a support portion and a supported portion;

the supported portion is supported by the support portion so as to be movable at least in the up-down direction;

the lower contact point and the press portion are provided on the supported portion; and when the object is connected to the connector, the supported portion and the insulator member are sandwiched between the object and the lower receiving portion.

3. The connector as recited in claim 1, wherein the lower receiving portion is provided on the lower-jaw portion so as to be movable at least in the up-down direction.

4. The connector as recited in claim 1, wherein the insulator member is distinct and separated from the housing.

5. The connector as recited in claim 1, wherein the object is sandwiched between the upper contact point and the lower contact point in the up-down direction when the object is connected to the connector.

6. The connector as recited in claim 5, wherein the upper contact point, the lower contact point, the press portion, the insulator member and the lower receiving portion are positioned on an imaginary straight line parallel to the up-down direction.

7. The connector as recited in claim 1, wherein:

the connector comprises two or more of the first terminals and two or more of the second terminals;

the first terminals are distinct and separated from each other;

the second terminals are distinct and separated from each other;

the first terminals correspond to the second terminals, respectively;

the housing holds the first terminals and the second terminals so that the two or more of the first terminals are arranged in a pitch direction perpendicular to the up-down direction while the two or more of the second terminals are arranged in the pitch direction; and one of the first terminals and the second terminal corresponding to the one of the first terminals are positioned at positions same as each other in the pitch direction.

8. The connector as recited in claim 7, wherein:

the insulator member comprises two or more insulation portions which are distinct and separated from each other; and the insulation portions are provided to correspond to the second terminals, respectively.

9. The connector as recited in claim 7, wherein:

the insulator member is formed of a single member which has a plurality of insulation portions; and the insulation portions are provided to correspond to the second terminals, respectively.

* * * * *